United States Patent [19]

Wollin

[11] Patent Number: 4,901,920

[45] Date of Patent: Feb. 20, 1990

[54] SNOW MAKING APPARATUS AND METHODS

[75] Inventor: Goesta Wollin, Clyde, N.C.

[73] Assignee: Snow Machines Incorporated, Midland, Mich.

[21] Appl. No.: 309,703

[22] Filed: Feb. 13, 1989

[51] Int. Cl.[4] ..... A01G 15/00

[52] U.S. Cl. ..... 239/2.2; 239/14.2; 239/222.11; 416/237

[58] Field of Search ..... 239/2.2, 14.2, 222.11; 416/237

[56] References Cited

U.S. PATENT DOCUMENTS 3,610,527 10/1971 Ericson et al. ..... 239/2.2

*Primary Examiner*—Andres Kashnikow
*Assistant Examiner*—William Grant
*Attorney, Agent, or Firm*—Learman & McCulloch

[57] ABSTRACT

Snow is produced by supplying water to the blades of a rotating fan. The blades are arranged in a plurality of sets of different length blades, each set having a relatively short blade, an intermediate length blade, and a relatively long blade. The quantities of water supplied to the blades and the speed of rotation of the fan are such that water spreads in a film over each blade toward its trailing edge and toward its tip. A proportion of the water discharged from each blade is atomized and entrained in the aerosol produced by rotation of the fan blades, whereas another proportion of the water discharged from each blade is cascaded in a vortex from one blade to the next following blade. The relative lengths of the blades are such that water cascaded from the tip of the longest blade in a leading set of blades impinges directly onto the longest blade of the immediately following set of blades.

30 Claims, 2 Drawing Sheets

V9
V8
V7a
V7c
V9c
8a
9a
7a
9
7b
2
A
8b
8
7
V7
7c
9b
8c
9c
2a

A 7a
9
8
7
13
14
15
13a
10
12
11
a
b
c

SNOW MAKING APPARATUS AND METHODS

This invention relates to apparatus and methods for producing snow, and particularly to portable apparatus for the production of snow at ski areas.

BACKGROUND OF THE INVENTION

There are many instances when it is desirable or necessary to manufacture snow so as to enable the use of ski facilities, for example, or to improve snow conditions at such facilities. Snow making equipment presently is available and generally is of two kinds. One makes use of compressed air to nucleate seeding ice crystals which then are mixed with water droplets within an aerosol or air stream of sufficiently low ambient temperature to make acceptable snow. The other kind of snow making equipment is a so-called airless snow making machine. The term "airless" is used to indicate the complete absence of compressed air as a nucleating agent. The apparatus disclosed herein relates to an airless machine for making snow.

The only known commercially available, truly airless snow making machine is that disclosed in Ericson et al U.S. Pat. No. 3,610,527 issued Oct. 5, 1971. The Ericson et al airless snow making apparatus discharges water onto the blades of a rotating fan adjacent its hub. The water spreads over the blades in a thin film the surface of which is subjected to evaporative cooling, thereby chilling the water. The majority of the water, however, passes over the trailing edges of the blades and is atomized as it enters the aerosol.

The known prior art airless apparatus also utilizes a fan having alternate blades of different lengths for the purpose of producing less recirculation of the aerosol at the blade tips. The effect of the reduced circulation is to increase the throw of the aerosol or, stated differently, the distance over which frozen water particles can remain entrained in the aerosol. The lower recirculation is attributed to the counteracting influence of one blade tip vortex on another. However, at higher ambient temperatures the lower recirculation can create a "halo" containing wet droplets which circulate around the fan and result in a localized fallout or wet spot in the immediate vicinity of the machine. The wet spot can be minimized by reducing the water supply to the machine, but this also causes a reduction in snow production.

The apparatus disclosed in the Ericson et al patent has the leading edges of the longer set of blades located at a greater distance from the water supply than the shorter set of blades, so that the longer blades receive less water. As a result, a thinner film of water passes over the longer blades, thereby producing increased chilling of such water and providing a larger quantity of ice nuclei to seed the aerosol. One effect of this differential water distribution is icing of the longer set of blades at extremely cold ambient temperatures. Varying the distribution of water to provide more water for the longer blades reduces the icing of the blades, but it also reduces the ice nuclei thereby resulting in reduction in snow production at both higher and marginal ambient temperatures. Thus, the production of snow at both the upper and lower operating temperature ranges is limited by the particular proportion of differential water distribution adopted.

An object of the present invention is to provide snow making methods and apparatus which overcome or greatly minimize the disadvantages referred to above.

SUMMARY OF THE INVENTION

The production of snow in accordance with the invention is effected by introducing water adjacent the roots of the blades of a rotating fan. The blades are grouped in sets of three wherein the first blade of each set is shorter than the second blade of each set and the second blade is shorter than the third blade of each set. The corresponding blades of each set are uniform in length, width, and all other characteristics.

Water is introduced to the respective blades in such quantities and the blades are rotated at such speed that some of the water is cascaded from the shortest blade of a set to the intermediate length blade of the same set, and water from the intermediate length blade is cascaded to the longest blade of such set. Furthermore, water from the tip of the longest blade of a leading set of blades is cascaded directly to the longest blade of the immediately trailing set of blades.

In addition to the cascading of water from one blade tip to another, water is discharged from the trailing edge of each blade, subjected to cooling by the cold ambient air in the airstream, and atomized to form ice nuclei to seed the aerosol.

The fan is rotated at such speed as to produce vortices at the tips of the blades. The vortices are helical and each has a radially inward flow path. As a consequence, a portion of each vortex, together with the moisture entrained therein, enters the spaces between the blades, thus causing the entrained moisture to be recirculated, so to speak, through the aerosol and over the blades, thereby enhancing chilling. It thus is possible to utilize a greater quantity of water than otherwise has been possible heretofore at relatively high temperatures while minimizing the halo effect. The utilization of additional water has the dual effect of super cooling the longest blade of each set and providing sufficient water on the longest blade to wash off ice which has a tendency to form because of the enhanced chilling.

THE DRAWINGS

Apparatus constructed in accordance with a preferred embodiment of the invention is illustrated in the accompanying drawings wherein.

THE PREFERRED EMBODIMENT

Figure 1:
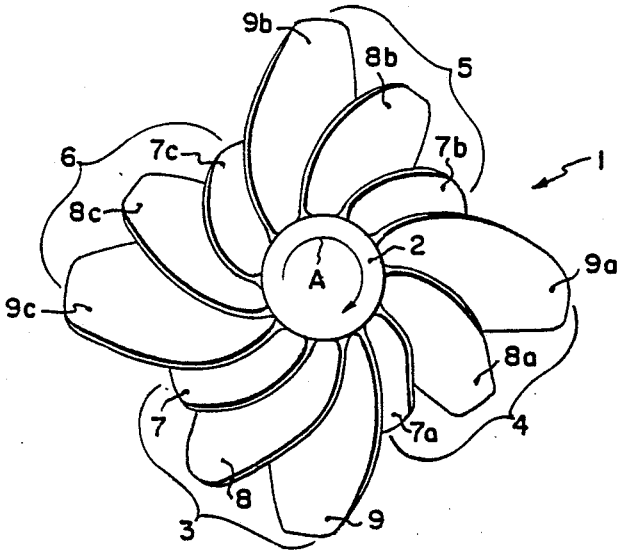
FIG. 1 is a plan view of a fan having four sets of three different length blades.

The preferred embodiment of the invention comprises a fan 1 having a hub 2 from which extends a mounting sleeve 2a that is adapted to be secured to a rotary shaft S of a driving motor M, as is conventional. The fan also includes a plurality of sets of blades. In the disclosed embodiment, there are four sets 3, 4, 5, and 6 of three blades each. The fan disclosed herein sometimes will be referred to as a 3-blade set fan.

The blades in each set are of different lengths. The shortest blade in the first set 3 is indicated by the reference character 7, the intermediate length blade is indicated by the reference character 8, and the longest blade is designated by the reference character 9. The corresponding blades in each of the remaining sets 4–6 are designated by corresponding reference characters followed by the suffixes a, b, and c, respectively. Each of the blades 7, **7*a*, 7*b*, and 7*c* is identical; each of the blades 8, 8*a*, 8*b*, and 8*c* is identical; and each of the blades 9, 9*a*, 9*b*, and 9*c*** is identical. The circumferential spacing between adjacent blades of each set is uniform and the circumferential spacing between each successive blade is uniform. The circumferential spacing of the blades is such that two of the shortest blades extend diametrally on the opposite sides of the hub, two intermediate length blades extend diametrally on opposite sides of the hub, and two of the longest blades extend diametrally on opposite sides of the hub.

The fan 1 is mounted so that its axis of rotation passes through the center of a water supply ring or collar 10 (FIG. 3) to which is connected a pipe or other conduit 11 by means of which water from a suitable source is delivered to the ring 10. The ring is provided with a plurality of circumferentially spaced openings which confront the adjacent side of the fan and through which water may pass in jets as indicated by the arrows 12 in FIG. 3.

Figure 2:
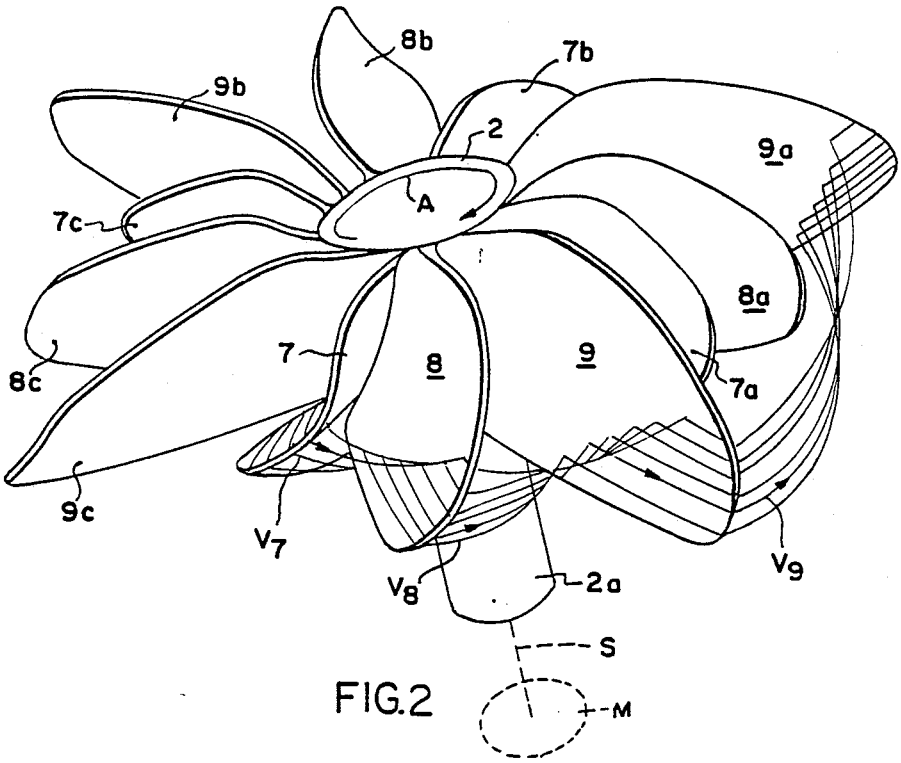
FIG. 2 is an isometric view of the fan and illustrating the vortex cascade sequence from blade to blade in one set thereof and from the longest blade of one set to the longest blade of the immediately trailing set of blades.
Figures 3, 4:
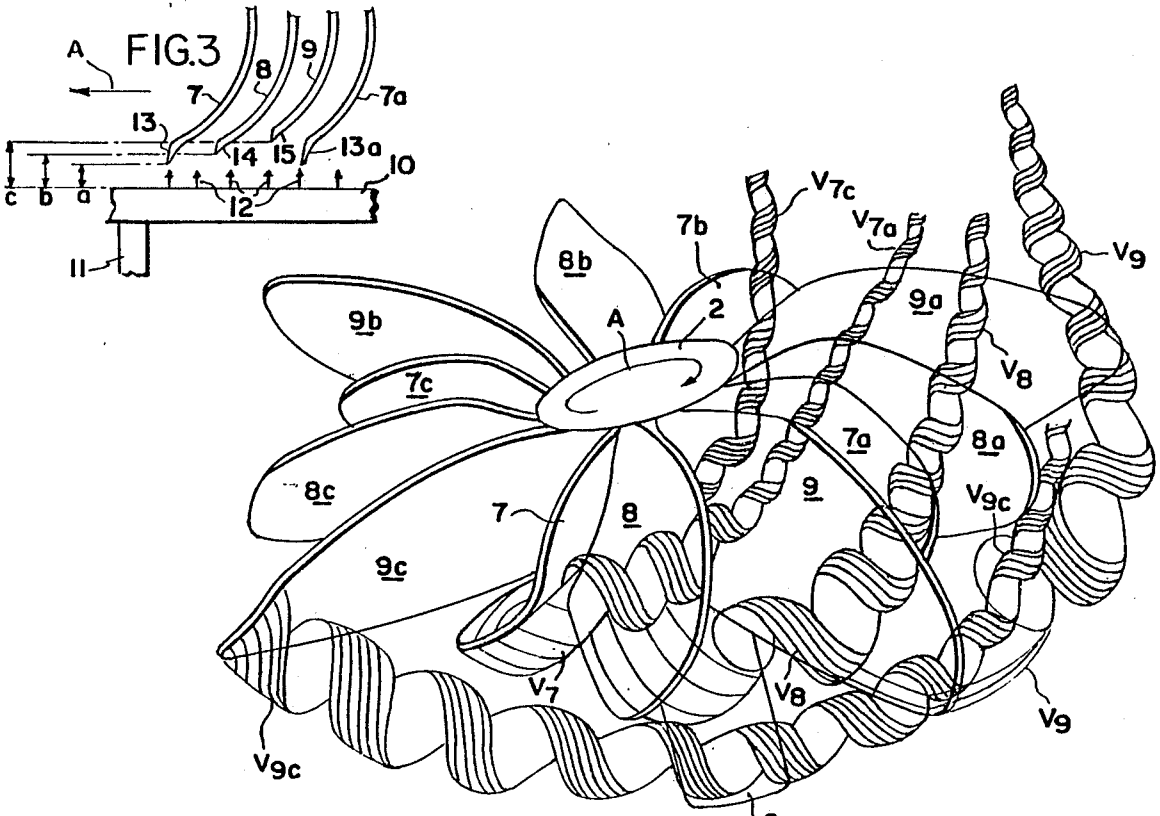
FIG. 3 is a diagrammatic view illustrating proportional water distribution to the respective blades of each set.
FIG. 4 is a view similar to FIG. 2, but illustrating other characteristics of the vortex cascade.

Each of the fan blades has a root that is joined to the hub 2 and from which the associated blade extends radially outwardly. The direction of rotation of the fan is such that the leading edges of the blades confront the water supply ring 10. The trailing edges of the blades have coplanar roots, as is best shown in FIG. 2, but the roots at the leading edges of the blades are displaced from one another longitudinally of the hub 2. As is shown in FIG. 3, the shortest blade 7 has the leading edge of its root 13 spaced a distance a from the water supply ring 10, the intermediate length blade has its root 14 spaced a distance b from the supply ring 10, and the longest blade 9 has its root 15 spaced a distance c from the supply ring. The same relationship exists between the leading ends of the roots of each of the remaining sets of blades.

As is shown in FIG. 3, the distance b is greater than the distance a, and the difference may be about 0.25 inch. The distance c also is greater than the distance b, and the difference again may be about 0.25 inch. Thus, as the fan rotates in the direction of the arrow A, the leading edge of each of the shortest blades 7, being closer than any other blade to the water supply, receives a greater quantity of water than either of the other blades of the associated set.

The only difference between the blades of the fan, other than the spacing of the leading edges of the roots from the water supply ring 10, is their length. The thickness, pitch, and curvature characteristics of the blades may correspond to those of the blades disclosed in the Ericson et al patent. In the preferred embodiment the shortest blade 7 of each set of blades has a nominal length of 5.5 inches, the intermediate length blade 8 of each set has a nominal length of 6.75 inches, and the longest blade 9 of each set has a nominal length of 8 inches. The diameter of the hub 2, measured from that end thereof shown in FIG. 4, is 4 inches. The greatest diameter of the fan, therefore, is 20 inches.

As the fan 1 is rotated in the direction of the arrow A and water is discharged from the supply ring 10 into the path of the blades, water picked up by the shortest blade 7 of the first blade set 3 will spread in a film radially outwardly and in the direction of the trailing edge of the blade as a result of rotation of the blade and the pitch thereof. Water picked up by each of the intermediate length and longest blades 8 and 9 of the blade set 3 similarly will spread in a film radially outwardly and toward the trailing edge of the respective blade.

Some portion of the water from the shortest blade 7 will be discharged from its trailing edge into the space between such trailing edge and the next following intermediate length blade 8. Some of this water will be atomized to form ice nuclei and entrained in the aerosol generated by rotation of the fan. The moisture not entrained by the aerosol will impinge upon the next following intermediate length blade and will be added to the water that has been picked up from the supply ring 10.

Some of the water discharged from the trailing edge of the intermediate length blade 8 will be atomized and entrained in the aerosol, whereas the remainder will impinge upon the immediately following longest blade 9 and added to the water picked up by that blade from the supply ring 10. A portion of the water thus spreading over the longest blade 9 will be discharged from the trailing edge thereof, atomized, and entrained in the aerosol.

In addition to water discharged from the trailing edge of the shortest blade 7, some water will be discharged or cascaded from the tip of such blade and entrained in a vortex generated by the speed of rotation of the fan. This vortex is indicated by the reference character $V_7$ in FIGS. 2 and 4. The vortex $V_7$ is of spiral configuration and has a radially inward flow path in a direction toward the hub 2. As a consequence, a portion of the vortex $V_7$ impinges directly on the immediately following intermediate length blade 8 inwardly of the tip of the latter, thereby adding moisture to the front surface of the blade 8.

The additional moisture cascaded from the blade 7 onto the blade 8 flows partially toward its trailing edge and partially toward its tip at which is a vortex $V_8$ which, like the vortex $V_7$, is of spiral configuration and has a flow path toward the hub 2. Thus, water cascaded over the tip of the blade 8 into the vortex $V_8$ impinges on the longest blade 9 inwardly of its tip, thereby adding to the water already on the blade 9 moisture from each of the preceding blades 7 and 8.

The additional moisture cascaded from the blade 8 onto the blade 9 spreads toward its tip and toward its trailing edge, thereby producing additional atomized nuclei for entrainment in the aerosol. Water also is cascaded over the tip of the blade 9 into a vortex $V_9$ whose characteristics are like those of the vortices $V_7$ and $V_8$.

The relative lengths of the blades 7, 8, and 9, and their circumferential spacing, are so selected that by far the major portion of the vortex $V_9$ passes beyond the shortest and intermediate blades of the immediately trailing set of blades and impinges upon the longest blade of the immediately following set of blades. Thus, as is shown clearly in FIG. 2, the vortex $V_9$ from the blade 9 impinges upon the immediately following longest blade **9*a* of the second blade set 4. Rotation of the blade 9*a* also generates a vortex like the vortex $V_9$ and it impinges on the next following longest blade 9*b***.

From the foregoing it will be understood that the fan is rotated at such speed that a proportion of water picked up by each fan blade from the water supply is cooled by movement over such blade and atomized in the same manner as is disclosed in the Ericson et al patent. It also will be clear that another proportion of the water on each blade is entrained in the vortex generated by rotation of each blade and cascaded to one or more trailing blades in several stages.

The cascading of water from one blade to another, to still another, and so on, coupled with the spiral configuration and radially inward flow path of the vortices, enables some proportion of the water to pass between adjacent blades and be subjected to considerably greater cooling than is the case in constructions wherein such multiple cascading is lacking. Multiple cascading thus results in a high percentage of chilled water, minimization of the halo effect, and an amount of water for washing ice off the blades. The exact number of times a particular stream of water is cascaded during its movement through the fan is variable depending upon the quantity of water supplied, the point of entry of the water, the speed of rotation of the fan, the structural relationship among the blades, and the velocity of the aerosol.

Comparison tests between the 3-blade set fan disclosed herein and a 2-blade set fan like that disclosed in the Ericson et al patent (both fans otherwise being the same size and the testing parameters being the same) have shown that the 3-blade set fan can produce snow at higher ambient temperatures. Such tests also have shown that the quantity of snow produced by the 3-blade set fan is greater than that produced by the 2-blade set fan and that the snow produced by the 3-blade set fan is drier than that produced by the 2-blade set fan.

This disclosure is representative of apparatus and methods according to the presently preferred embodiments of the invention, but is intended to be illustrative rather than definitive thereof. The invention is defined in the claims.

What is claimed is:

1. In a fan for use in making snow wherein said fan has a hub rotatable about an axis and a plurality of radially extending blades secured to said hub and circumferentially spaced about said axis, the improvement wherein said blades are grouped in successive sets each of which comprises a first blade, a second blade, and a third blade, said first blade of each set being of shorter radial length than said second blade of such set, and said second blade of each set being of shorter radial length than said third blade of such set.

2. A fan according to claim 1 wherein the circumferential spacing between the blades of each set is substantially uniform.

3. A fan according to claim 1 wherein the circumferential spacing between each of said blades is substantially uniform.

4. A fan according to claim 1 wherein the radial length of the first blade in each of said sets is substantially uniform.

5. A fan according to claim 1 wherein the radial length of the second blade in each of said sets is substantially uniform.

6. A fan according to claim 1 wherein the radial length of the third blade in each of said sets is substantially uniform.

7. A fan according to claim 1 wherein the relative lengths of the blades in each set of blades are such that portions of blade tip vortices generated by rotation of said blades are cascaded successively from the first blade in each set of blades to the second blade of such set of blades to the third blade of such set of blades and from the third blade of each set of blades to the third blade of the trailing set of blades.

8. A fan according to claim 7 wherein the relative lengths of the blades of each set thereof are such that the third blade of each trailing set of blades receives directly vortices cascaded from the third blade of the immediately leading set of blades.

9. Snow making apparatus comprising a fan having a hub; means mounting said hub for rotation about an axis; a plurality of blades secured to said hub for rotation therewith and being circumferentially spaced about said axis, said blades being grouped in successive sets each of which comprises a first blade, a second blade, and a third blade, said first blade of each set being of shorter radial length than the second blade of such set, and the second blade of each set being of shorter radial length than the third blade of such set, each of said blades having a radially inner root and a radially outer tip; means for supplying water to each of said blades; and means for rotating said hub at a speed sufficient to cause some of the water supplied to each of said blades to cascade from its tip onto a radially longer trailing blade.

10. Apparatus according to claim 9 wherein the third blade of each set of blades is of such radial length that water from the tip thereof is cascaded directly to the third blade of the immediately trailing set of blade.

11. Apparatus according to claim 9 wherein the radial lengths of the blades in each set are such that water from the tip of the first blade in each set is cascaded to the second blade of such set, water from the tip of the second blade in such set is cascaded to the third blade of such set, and water from the tip of the third blade of such set is cascaded to the third blade of the immediately trailing set of blades.

12. Apparatus according to claim 9 wherein the circumferential spacing between the blades of each set of blades is substantially uniform.

13. Apparatus according to claim 9 wherein the circumferential spacing between each of said blades is substantially uniform.

14. Apparatus according to claim 9 wherein the radial length of the first blade in each of said sets is substantially uniform.

15. Apparatus according to claim 9 wherein the radial length of the second blade in each of said sets is substantially uniform.

16. Apparatus according to claim 9 wherein the radial length of the third blade in each of said sets is substantially uniform.

17. Apparatus according to claim 9 wherein each of said blades has a root joined to said hub, the root at the leading edge of each of the second and third blades of each set thereof being displaced longitudinally of said axis relative to the root at the leading edge of the first blade in such set and to one another.

18. Apparatus according to claim 17 wherein the longitudinal displacement of the root at the leading edge of the second blade of each set from the root at the leading edge of the first blade of said set corresponds substantially to the longitudinal displacement of the root of the leading edge of the third blade of each set from the root of the leading edge of the second blade of such set.

19. Apparatus according to claim 9 wherein the water supply means comprises a collar encircling said hub adjacent the juncture of said blades and said hub, said collar having water outlets extending circumferentially of said axis and confronting said blades.

20. Apparatus according to claim 19 wherein the blades in each set thereof have roots positioned at different distances from said collar.

21. Apparatus according to claim 20 wherein the root of the first blade of each set thereof is closer to said collar than is the root of the second blade of such set and the root of the second blade of each set thereof is closer to said collar than is the root of the third blade of such set.

22. Apparatus according to claim 21 wherein the distance between the roots of the first and second blades of each set thereof corresponds substantially to the distance between the roots of the second and third blades of such set.

23. A method of making snow comprising supplying water from a source thereof to rotating fan blades and in such quantity that water may pass over each blade in a film from its leading edge toward its trailing edge and from its root radially outwardly to its tip; rotating said blades at a speed to produce an aerosol in which water discharged from the blades may be entrained; cascading water from a leading blade onto an immediately trailing blade; cascading water from said immediately trailing blade onto a further trailing blade; and cascading water from said further trailing blade partially into said aerosol and partially onto another trailing blade corresponding to said further trailing blade, whereby the water passing over said further trailing blade includes water from said source, water cascaded from said immediately trailing blade, and water cascaded from an upstream blade corresponding to said further trailing blade.

24. In a method of making snow wherein water is supplied from a source thereof to a fan rotating about an axis and having a plurality of sets of different length blades, the improvement comprising arranging the blades of each of said sets in such manner that the shortest blade is the leading blade of each set and is followed by an intermediate length blade which is followed by the longest blade, and rotating said fan at such speed that a portion of the water on each blade is discharged from its trailing edge and another portion of such water is discharged from the tip of such blade in a vortex and is cascaded onto the next following longer blade.

25. The method according to claim 24 wherein the vortex has a radially inward flow component.

26. The method according to claim 24 including supplying a greater quantity of water from said source to that blade of each set which has the least radial length.

27. The method according to claim 24 including supplying the least quantity of water from said source to that blade of each set which has the greatest radial length.

28. The method according to claim 24 including supplying the greatest amount of water to the shortest blade of each set, supplying the least amount of water to the longest blade of each set, and supplying an intermediate amount of water to the intermediate length blade of each set.

29. A method of making snow comprising applying to each of the blades of a rotary fan an amount of water sufficient to enable the water to flow across the surface of such blade toward its trailing edge and toward its tip, the blades of said fan being composed of a plurality of sets of blades each set of which includes at least three blades and each trailing one of which is longer than the immediately preceding blade; and rotating said fan at a speed sufficient to cause water from each of said blades to be cascaded over the tip thereof and impinge on the next following blade of equal or greater length.

30. The method according to claim 29 including rotating said fan at a speed sufficient to generate a vortex from the tip of each blade in which water cascaded from such tip is entrained.

* * * * *